United States Patent [19]

Takatsu

[11] 4,346,579

[45] Aug. 31, 1982

[54] HEMMING APPARATUS

[76] Inventor: Huehiro Takatsu, c/o Kabushiki Kaisha Takatsu Seisakusho, 22, 3-chome, Nanabancho, Minato-ku, Nagoya-shi, Aichi-ken, Japan

[21] Appl. No.: 130,528

[22] Filed: Mar. 14, 1980

[30] Foreign Application Priority Data

Mar. 15, 1979 [JP] Japan ..... 54-30418

[51] Int. Cl.[3] ..... B21D 5/04; B21D 5/16; B21D 11/00

[52] U.S. Cl. ..... 72/314; 72/319; 72/387; 72/450; 29/243.58

[58] Field of Search ..... 72/312-315, 72/300, 319-323, 387, 388

[56] References Cited

U.S. PATENT DOCUMENTS

| | | | |
|---|---|---|---|
| 1,527,375 | 2/1925 | Nystrom | 72/314 |
| 1,572,376 | 2/1926 | Bingham | 72/315 |
| 1,785,537 | 12/1930 | Stevens | 72/314 |
| 2,370,128 | 2/1945 | Aneiros | 72/320 |
| 3,058,512 | 10/1962 | Chebuhar et al. | 72/312 |

FOREIGN PATENT DOCUMENTS

| | | | |
|---|---|---|---|
| 189030 | 2/1957 | Austria | 72/312 |
| 712749 | 7/1965 | Canada | 72/313 |
| 41-20710 | 4/1966 | Japan . | |
| 53-44466 | 11/1978 | Japan . | |
| 475190 | 6/1975 | U.S.S.R. | 72/315 |

*Primary Examiner*—Daniel C. Crane
*Attorney, Agent, or Firm*—Stevens, Davis, Miller & Mosher

[57] ABSTRACT

A hemming apparatus comprising a lower body, an upper body vertically movable with respect to the lower body, a main hemming means connected by links to the upper body, a shifting cam provided on the main hemming means so as to shift the main hemming means laterally in accordance with the downward movement of the upper body, a guide provided on the lower body and adapted to be engageable with the shifting cam, and a bending blade attached to the main hemming means and consisting of integrally formed blade members one of which is used for a preliminary bending of a work and the other of which is used for a primary bending of the work.

7 Claims, 7 Drawing Figures

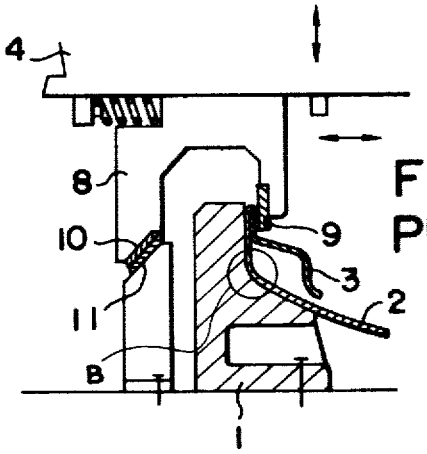
FIG. 4
PRIOR ART
FIG. 6
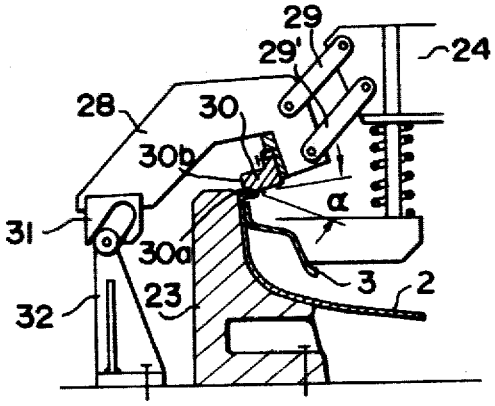
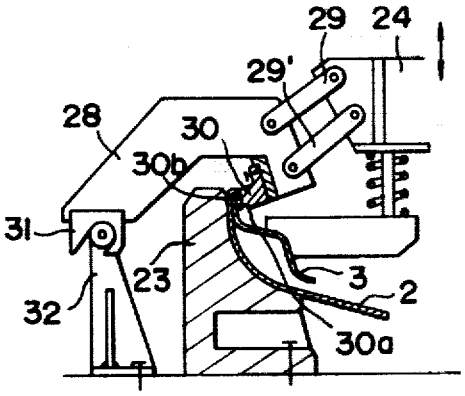
FIG. 7

HEMMING APPARATUS

BACKGROUND OF THE INVENTION

1. Field of the Invention

The present invention relates to a hemming apparatus for a double plate structure consisting of an outer plate and an inner plate and more particularly to a hemming apparatus for bending an edge portion of the outer plate so as to be folded around the opposed edge portion of the inner plate.

2. Description of the Prior Art

A bonnet, side doors, a luggage compartment door, etc. of a motorcar are usually of a double structure consisting of inner and outer plates, in which structure the edge portion of the outer plate is bent and folded around the opposed edge portion of the inner plate.

Taking a bonnet of a motorcar as an example, an operation of bending an outer plate by a conventional hemming apparatus will be described.

First, an outer plate 2 of a work is placed on a bottom form 1 of a press as shown in FIG. 1, and an inner plate 3 is then set on the outer plate 2.

A top form 4 of the press is lowered to allow a preliminary bending cam 5 attached thereto to come into engagement with a preliminary bending arm 6 pivotally connected to the bottom form 1. The preliminary bending arm 6 is then rotated toward the work to allow a preliminary bending blade 7 attached to the arm 6 to press against an edge portion of the outer plate 2. Thus, the edge portion of the outer plate 2 is bent to such an extent that it is conveniently subject to a primary bending operation which is carried out afterwards.

When the top form 4 is then further lowered, the preliminary bending cam 5 comes out of engagement with the preliminary bending arm 6 as shown in FIG. 3, so that the arm 6 is returned to its original position to thereby render the space above the bent edge portion of the outer plate 2 clear.

When the top form 4 is lowered still further, a laterally slidable slider 8 provided on that portion of the top form 4 which is arranged to be above the bent edge portion of the outer plate 2 is moved close thereto as shown in FIG. 4, so that a primary bending blade 9 attached to the slider 8 comes into engagement with the primarily-bent edge portion of the outer plate 2. Thus, the edge portion of the outer plate 2 is subjected to a finishing bending operation so as to be bent around the opposed edge portion of the inner plate 3.

In this case, it is necessary that at the same time as the primary bending blade 9 moves downwardly, it should slide laterally in the direction in which the work is pressed. Accordingly, slider 8 is adapted to move laterally as it moves downwardly, by providing a slide cam 10 thereon which is engageable with a cam 11 having an inclined surface and attached to the bottom form 1.

A conventional hemming apparatus mentioned above permits bending work up to a final stage by conducting preliminary and primary bending operations independently in the mentioned order during one downward movement of the top form 4 for each of the bending operations.

However, the preliminary bending mechanism of this type should be removed from the space above the work before starting a primary bending operation. Accordingly, this type of hemming apparatus necessarily has a complicated construction. Moreover, since the shapes of the peripheral edges of the work are often different on all sides of a bonnet, the work may possibly be displaced on the bottom form 1 during a preliminary or primary bending operation and as a result, the work may not be properly formed. Furthermore, a large downward force is applied to the outer plate 2 at the primary bending so that such a portion thereof that is designated by a symbol B in FIG. 4 buckles, for example in a shape of creases, wrinkles or the like.

Therefore there is a need for a hemming apparatus of this kind to be further improved so as to solve the above-mentioned problems.

SUMMARY OF THE INVENTION

An object of the present invention is to provide a novel hemming apparatus wherein the advantage of a conventional hemming apparatus of continuously carrying out preliminary and primary bending operations by lowering movement of a top form is retained, while simplifying the apparatus, preventing displacement of the work at bending-formations, and preventing the occurrence of wrinkles on an outer plate.

To this end, the present invention provides a hemming apparatus comprising a fixed lower body; an upper body vertically movable with respect to the lower body; a main hemming means connected by links to the upper body; a bending blade attached to the main hemming means and consisting of integrally formed blade members one of which is used for a preliminary bending of the work and the other of which is used for a primary bending of the work; a guide attached to the lower body; and a shifting cam attached to the main hemming means and engageable with the guide so as to shift the main hemming means laterally in accordance with the downward movement of the upper body, the guide coming into engagement with the shifting cam to move the main hemming means such that the preliminary bending blade member is applied to the work at an angle and such that the primary bending blade member is positioned parallel to the opposed surface of a form when the work is in a final stage of bending operation.

The above and other objects as well as advantageous features of the invention will be become clear from the following description of preferred embodiments taken in conjunction with the accompanying drawings.

BRIEF DESCRIPTION OF THE DRAWINGS

FIGS. 1–4 are sectional views of a principal portion of a conventional hemming apparatus, wherein:

FIG. 1 shows a work set on a bottom form;

FIG. 2 shows the work subjected to a preliminary bending operation;

FIG. 3 shows a preliminary bending means removed from the space above the preliminarily bent edge portion of the work; and FIG. 4 shows the work subjected to a primary bending operation.

FIG. 6 is a sectional view of a principal portion of the hemming apparatus shown in FIG. 5, which is in an initial stage of a preliminary bending operation; and FIG. 7 is a sectional view of a principal portion of the hemming apparatus shown in FIG. 5, which is at the completion of a primary bending operation.

DESCRIPTION OF THE PREFERRED EMBODIMENT

A hemming apparatus embodying the present invention will be described with reference to the accompanying drawings.

Figure 5:
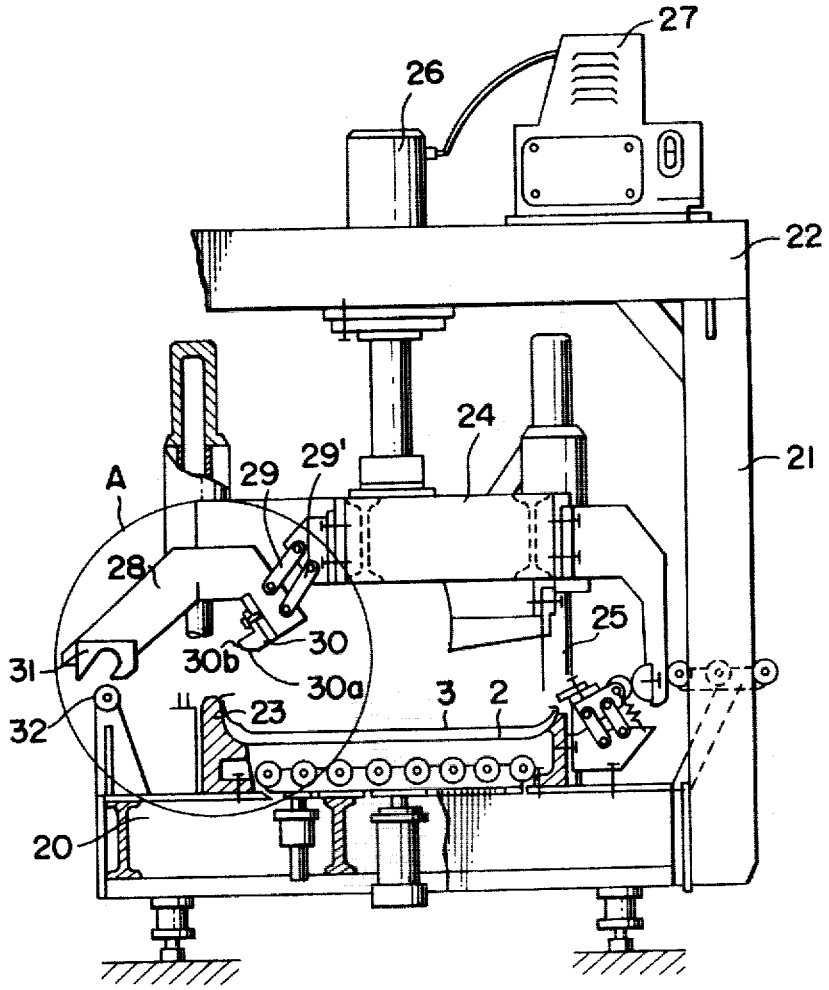
FIG. 5 is a sectional view of a hemming apparatus as a whole embodying the present invention.

FIG. 5 is a sectional view of a hemming apparatus according to the present invention.

Reference numeral 20 denotes a table constituting a lower body of the hemming apparatus, 21 a post set up on the lower body 20, 22 an upper beam secured to an upper end portion of the post 21, 23 a bottom form fixed on the table and constituting a part of the lower body 20, 24 a ram serving as an upper body and movable toward and away from the lower body 20, 25 a post for vertically guiding the ram 24, 26 a high-pressure cylinder secured to the upper beam 22 and adapted to vertically move the ram 24 with respect to the lower body 20, and 27 an oil-pressure pump unit for actuating the high-pressure cylinder 26.

The embodiment shown in the accompanying drawings employs a cylinder for vertically moving the upper body 24, but a means used for this purpose is not limited to a cylinder. In order to vertically move the upper body 24, such a means may be used that consists of a screw rod fixed into the upper body 24, a female screw member provided in the upper beam 22 and engageable with the screw rod, and a motor for rotating the female member. Also, for the vertical movement of the upper body, such a means may be employed that consists of a screw rod provided on the upper beam 22 parallel thereto and rotated by a motor, a pair of nut means having right-hand and left-hand screws fitted around the screw rod, and a link mechanism for transmitting to the upper body 24 the movements of these nuts toward and away from each other in accordance with the rotation of the screw rod.

FIGS. 6 and 7 show different stages of operation of a section designated by a symbol A in FIG. 5.

Referring to these drawings, reference numeral 28 denotes a main hemming means connected by links to the ram constituting the upper body 24. The main hemming means 28 is connected to the ram 24 by two pivotally movable links 29, 29' extended therebetween. The links 29, 29' may be equal or different in length if they have a predetermined function which will be described later. When the links 29, 29' are equal in length, the main hemming means 28 is rotated around the end portion of the ram 24 as the main hemming means 28 maintains a constant posture. When the links 29, 29' are different in length, the main hemming means 28 is rotated around the end portion of the ram 24 as the main hemming means 28 varies its rotational postures.

The main hemming means 28 is provided with a bending blade 30 at the end portion thereof which is on the side of the work. The bending blade 30 is integrally formed with a preliminary bending blade member **30*a* and a primary bending blade 30*b*. The preliminary bending blade member 30*a* is brought into contact with an edge portion of the outer plate 2 so as to primarily bend the same, and the primary bending blade 30*b* primarily bends the preliminarily bent outer plate 2 to a finished state. These blade members 30*a*, 30*b* consist of surfaces of the bending blade 30**, which surfaces are extended at an angle to each other.

The main hemming means 28 is provided with a shifting cam 31 at that end portion thereof which is on the opposite side of the work. Shifting cam 31 is adapted to shift the main hemming means 28 in the lateral direction in accordance with the vertical movements of the ram 24.

The table 20 is provided with a guide 32 engageable with the shifting cam 31.

The shifting cam 31 shown in the drawings has a diagonally extending recess at the lower end thereof and the guide 32 is provided with a roller, but these may be reversed, of course. Namely, the shifting cam 31 may be provided with a roller and the guide 32 may be formed with such a recess. Also, a cam-guide means having the same function may be used.

The shifting cam 31 comes into engagement with the guide 32 in such a manner that the preliminary bending blade member **30*a* acts on an edge portion of the outer plate 2 at an angle $\alpha$ which is between 20° and 70° (a state that the blade member 30*a* impinges upon the work is shown in FIG. 6) in accordance with the downward movement of an aggregate of the upper body 24, main hemming means 28 and bending blade 30. Also primary bending blade member 30*b* becomes parallel to the face of the bottom form 23 opposed thereto in a final bending operation for the outer plate 2 (as shown in FIG. 7). The shape of engagement of the shifting cam 31 and guide 32** are selected so as to ensure the above-described movements of each part.

The operation of a hemming apparatus having the above construction will be described.

Figure 1:
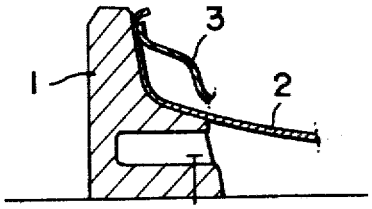
FIG. 1 PRIOR ART
Figure 2:
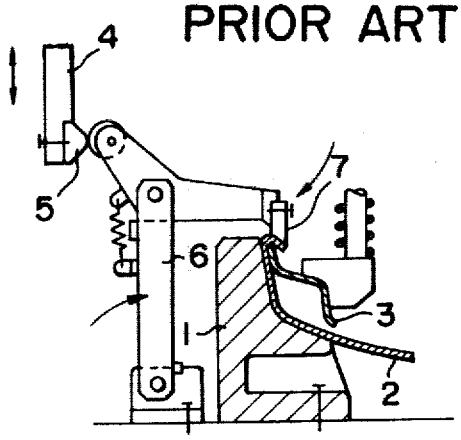
FIG. 2 PRIOR ART
Figure 3:
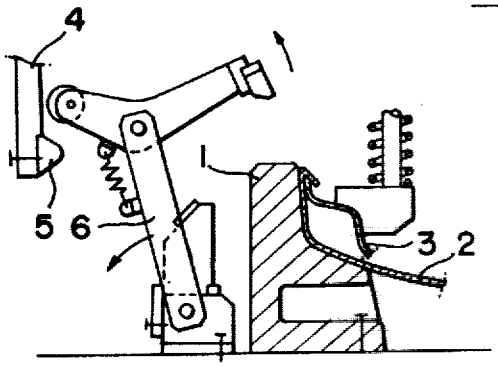
FIG. 3 PRIOR ART

First, a combination of an outer plate 2 and an inner plate 3 is set on the bottom form 23 in the same manner as in a conventional hemming apparatus shown in FIG. 1.

An oil pressure pump unit 27 is then actuated to lower ram 24 close to table 20.

When the ram 24, main hemming means 28 and bending blade 30 are downwardly moved, the preliminary bending blade member **30*a* comes into contact with the outer plate 2 at a predetermined angle $\alpha$ of from 20° to 70°. The contacting of the blade member 30*a* and outer plate 2 at an angle in the mentioned range allows a reasonable preliminary bending of the latter. The blade member 30*a* and outer plate 2 in such a preliminary bending operation is shown in FIG. 6**.

When the ram 24 is further lowered, the edge portion of the outer plate 2 is pressed to the left in FIG. 6 in a reasonable manner by the preliminary bending blade member **30*a* owing to the actions of shifting cam 31 and shifting guide 32** while being pressed thereby downwardly at the same time.

When the ram 24 is slightly lowered still further that portion of the outer plate 2 contacting bending blade 30 is shifted from the preliminary bending blade member **30*a* to the primary bending blade member 30*b*. Thus, the preliminarily bent edge portion of the outer plate 2 is shifted by the primary bending blade member 30*b* in a direction in which an edge portion of the inner plate 3 is wrapped with the preliminarily bent edge portion of the outer plate 2, and bent until the edge portion of the inner plate 3 is tightly held in that of the outer plate 2 as shown in FIG. 7. At this time, the edge portion of the outer plate 2 is in a final state in which a primary bending of the outer plate 2** has been completed.

In this primary bending stage, an upwardly directed force consisting of a reaction force from the outer plate 2 which is applied to the main hemming means 28, is smoothly converted into a force by which the main hemming means 28 is moved to left in the drawing through cooperation of the links 29, 29', shifting cam 31 and guide 32. As a result, a force by which the edge portion of the outer plate 2 is downwardly pressed by the main hemming means 28 is reduced to a great extent. Accordingly, the outer plate 2 engaged at its rear surface with the concave surface of the bottom form 23 is never displaced during a bending operation, and no wrinkles occur in the outer plate 2.

In a final stage of a bending operation for shaping a bonnet and the like, the work is set in a hemming apparatus with three edge portions of the work already substantially finished being primarily bent and, therefore, the displacement of the work can be prevented completely. In this shaping operation, preliminary and primary bending of a work can be effected simultaneously during one downward movement of a ram 24.

In the above-described embodiment, the lower body 20 is fixed, and the upper body 24 is adapted to be vertically moved with respect to the lower body 20. The entirely same bending effect can be obtained if the upper body is fixed, with the lower body 20 adapted to be vertically movable with respect to the upper body.

Since the hemming apparatus according to the present invention consists of upper and lower bodies one of which can be moved toward and away from the other, the main hemming means connected to one of the bodies, and a bending blade connected to one of the bodies by links and having integrally formed blade members one of which is used for a preliminary bending of a work and the other of which is used for a primary bending of the work, the work can be subjected to preliminary and primary bending operations simultaneously by vertical movement of either one of the bodies.

In the hemming apparatus according to the present invention, the main hemming means is connected to either the upper or lower bodies by links, the shifting cam is provided on either the main hemming means or the body to which the main hemming body is not connected while the guide engaging with the shifting cam is provided on the other. And the shifting cam and guide come into engagement with each other to allow the main hemming body to move such that the preliminary bending blade member acts on the work at an angle of 20° to 70° and such that a primary bending blade member is positioned parallel to the opposed form surface at the end of a primary bending operation. Accordingly, a preliminary bending blade member can act on the work at a reasonable angle to bend the same properly, and a primary bending blade member permits pressing the preliminarily bent edge portion of the work against the form surface without applying an unduly great vertical force to the work, so that the work can be folded tightly around the opposed edge portion of an inner plate in a final stage of the bending operation.

Since an unduly great vertical force can be prevented from being applied to the work, it is never displaced on the surface of the form, and wrinkles never occur on the work.

What is claimed is:

1. A hemming apparatus comprising a lower body, a bottom form mounted on said lower body, an upper body mounted on said lower body and vertically movable with respect to said lower body so as to clamp a work intermediate said bottom form and said upper body, a main hemming means, a pair of links connecting said main hemming means to said upper body, which operate as a parallel linkage in a vertical direction, and inclined downwardly to the main hemming means from the upper body, a bending blade attached to said main hemming means and comprising integrally formed bending blade members one of which is used for a preliminary bending of the work and the other of which is used for a primary bending of the work, a guide attached to said lower body and a shifting cam attached to said main hemming means and engageable with said guide so as to shift said main hemming means laterally with respect to the vertical movement in accordance with the downward movement of said upper body and the movement of said links wherein means is provided for raising the upper body to an extent that said main hemming means is in spaced, noncontacting relation to said guide, said guide coming into engagement with said shifting cam to move said main hemming means such that said preliminary bending blade member is applied to the work at an angle with respect to the surface to be hemmed and such that said primary bending blade member is positioned parallel to the surface of the bottom form when the work is in its final bent stage.

2. The hemming apparatus according to claim 1, wherein said guide comprises a roller; and said shifting cam comprising a recess opened at the lower end thereof, said recess extending diagonally from vertical so as to shift the main hemming means laterally in accordance with the downward movement of said upper body.

3. The hemming apparatus according to claim 1, wherein said links are each pivotally connected at one end to said upper body and at the other end to said main hemming means.

4. The hemming apparatus according to claim 3, wherein said two links are of equal length.

5. The hemming apparatus according to claim 1, wherein said bending blade is attached to said main hemming means such as to allow said preliminary bending blade to act on the work at an angle of from 20° to 70° with respect to a surface to be hemmed at the moment when said bending blade contacts the work while said upper body is downwardly moving.

6. A hemming apparatus comprising:

a lower body onto which is placed a work to be hemmed, said lower body having a guide;

an upper body mounted on said lower body being vertically movable with respect to said lower body said upper body movable for clamping the work between said lower body and said upper body;

a pair of links pivotably mounted on said upper body operating as a parallel linkage in a vertical direction and inclined downwardly main hemming means pivotably mounted to said pair of links such that the movement of said main hemming means with respect to the upper body is constrained by the angular movement of said links, a shifting cam attached to said main hemming means engageable with said guide of the lower body so as to shift the main hemming means laterally with respect to the vertical movement as the main hemming means moves vertically downward, means for raising the upper body to an extent that said main hemming means is in spaced, noncontacting relation to said guide, a bending blade attached to said main hemming means comprising integrally formed bending blade members, one of which being for preliminary bending of the work and the other of which being for primary bending of the work, said links and the engagement of said shifting cam and said guide governs the downward and lateral movement of the main hemming means so that the preliminary bending blade surface initially engages the work at an angle, as the downward movement of the upper body continues, the preliminary bending blade partially folds the work, further downward movement of the upper body means causes the primary bending blade to move substantially laterally against the work to complete the hem.

7. A hemming apparatus comprising a lower body, a bottom form mounted on said lower body, an upper body mounted on said lower body and vertically movable with respect to said lower body for clamping a work disposed intermediate said upper body and said bottom form, a main hemming means, links connecting said main hemming means to said upper body, a bending blade attached to said main hemming means and comprising integrally formed bending blade members one of which is used for a preliminary bending of a work and the other of which is used for a primary bending of the work, a guide attached to said lower body and a shifting cam comprising a recess opened at a lower end thereof, said shifting cam being attached to said main hemming means and engageable with said guide, said recess extending diagonally from vertical so as to shift the main hemming means laterally with respect to the vertical movement in accordance with the downward movement of said upper body and the movement of said links, said guide comprising a roller and coming into engagement with said shifting cam to move said main hemming means such that said preliminary bending blade member is applied to the work at an angle with respect to the surface to be hemmed and such that said primary bending blade member is positioned parallel to the surface of the bottom form when the work is in its final bent stage.

* * * * *